US007178449B2

(12) United States Patent
Porel

(10) Patent No.: US 7,178,449 B2
(45) Date of Patent: Feb. 20, 2007

(54) HYDRAULIC DEVICE DRIVING A ROTATING RECEIVER

(75) Inventor: Louis-Claude Porel, Jeanmenil (FR)

(73) Assignee: Hydro Leduc, Azerailles (FR)

( * ) Notice: Subject to any disclaimer, the term of this patent is extended or adjusted under 35 U.S.C. 154(b) by 36 days.

(21) Appl. No.: 11/177,596

(22) Filed: Jul. 11, 2005

(65) Prior Publication Data

US 2006/0005698 A1 Jan. 12, 2006

(30) Foreign Application Priority Data

Jul. 12, 2004 (FR) ..... 04 07742

(51) Int. Cl.
*F01B 3/00* (2006.01)
*F01B 13/04* (2006.01)

(52) U.S. Cl. ..... 92/71; 92/12.2; 92/57

(58) Field of Classification Search ..... 92/12.2, 92/57, 71; 417/269
See application file for complete search history.

(56) References Cited

U.S. PATENT DOCUMENTS

| | | | | |
|---|---|---|---|---|
| 2,096,907 | A * | 10/1937 | Linderman | 91/500 |
| 3,199,378 | A | 8/1965 | Giovanni et al. | |
| 3,365,981 | A | 1/1968 | Gantzer et al. | |
| 3,731,593 | A * | 5/1973 | Chivari | 91/487 |
| 5,317,873 | A * | 6/1994 | Okuda et al. | 60/487 |
| 5,353,595 | A * | 10/1994 | Hayashi et al. | 60/489 |
| 5,415,530 | A * | 5/1995 | Shilling | 417/269 |
| 5,542,307 | A | 8/1996 | Hasegawa et al. | |
| 6,250,414 | B1 | 6/2001 | Sato et al. | |

FOREIGN PATENT DOCUMENTS

| | | |
|---|---|---|
| CH | 296 213 A | 1/1954 |
| DE | 19 45 440 A | 3/1971 |
| GB | 1 004 050 A | 9/1965 |

* cited by examiner

*Primary Examiner*—Igor Kershteyn
(74) *Attorney, Agent, or Firm*—Young & Thompson

(57) ABSTRACT

Hydraulic device driving a rotating receiver such as a shaft (1) includes at least one hydraulic motor having axial pistons (7) bearing against a fixed swash-plate (9) via shoes (10), the pistons (7) being arranged in a rotating barrel (5), characterized by the fact that the motor shaft (1) carries a toothed crown wheel (2) with which it is integral whose teeth are engaged by teeth (4) provided on the periphery of the rotating barrel (5) of one or more hydraulic motors (7) arranged around the shaft (1), the axis of axes of the barrel (5) being parallel to the axis of the shaft (1).

5 Claims, 3 Drawing Sheets

HYDRAULIC DEVICE DRIVING A ROTATING RECEIVER

FIELD OF THE INVENTION

The present invention pertains to improvements to axial-piston hydraulic motors and more particularly to axial pistons having an alternating movement via a swash-plate.

BACKGROUND OF THE INVENTION

It is known to manufacture hydraulic motors of this type in which the swash-plate is fixed in rotation, the pistons being arranged in a barrel piston chamber.

In motors of this type, the barrel is integral with the motor shaft driving the mechanical elements to which it is to give movement. This has the disadvantage that this type of transmission is scarcely compact.

SUMMARY OF THE INVENTION

One first object of the invention is to achieve a very compact transmission.

A second object of the invention is to make it possible, while maintaining a very compact transmission, to couple one or more motors to said drive shaft The hydraulic motor of the invention is characterized by the fact that it comprises a motor shaft driven by direct mechanical transmission via one or more hydraulic motors arranged around said shaft.

Preferably the motor shaft comprises an inlet crown wheel on which the teeth of the barrel piston chamber mesh, axial pistons being arranged inside the barrel and bearing upon a swash-plate.

BRIEF DESCRIPTION OF THE DRAWINGS

As an example and to facilitate the understanding of the invention, the following appended drawings show.

DETAILED DESCRIPTION OF THE INVENTION

Figure 2:
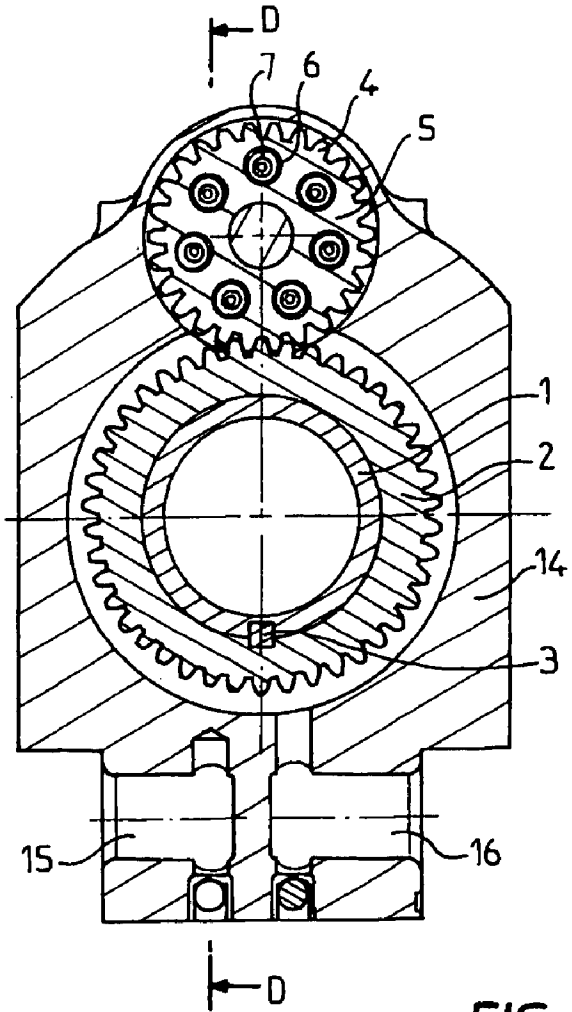
FIG. 2: a cross-sectional view along CC in FIG. 1.
Figure 1:
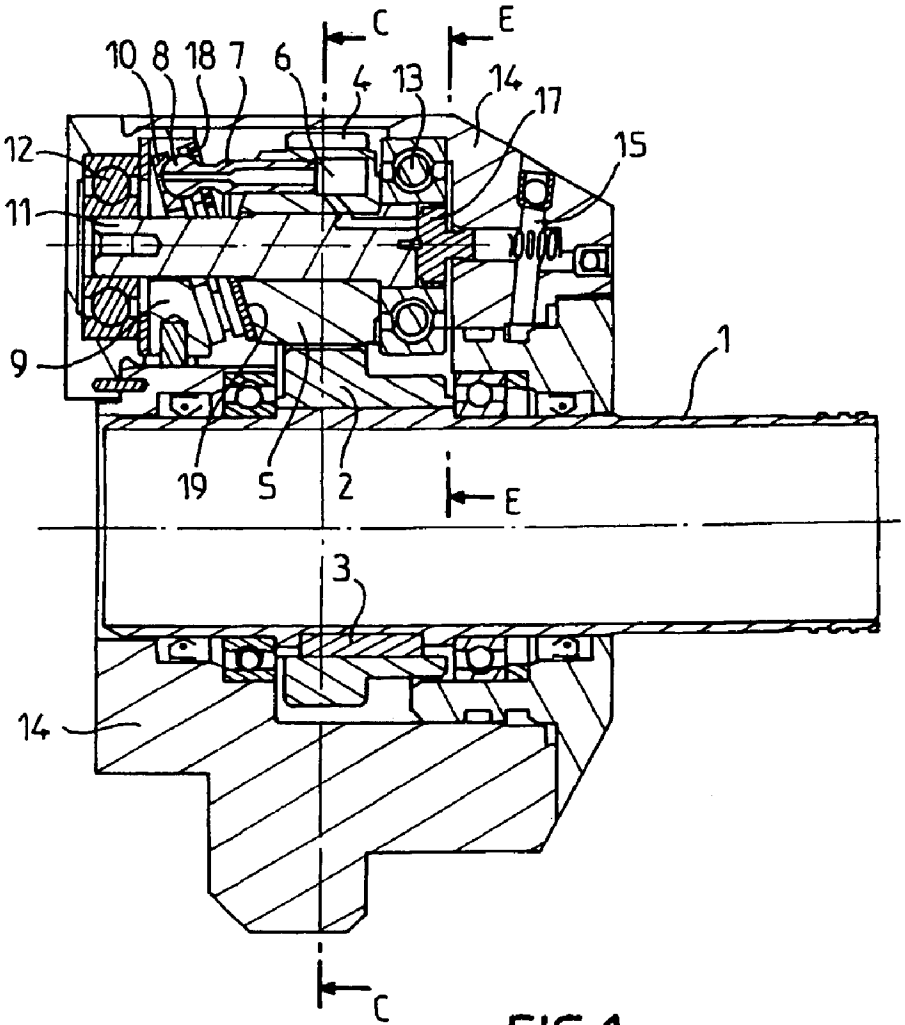
FIG. 1: a longitudinal section view of a first example of embodiment of the invention.

With reference to FIGS. 1 and 2, it can be seen that the motor shaft 1 is made integral with a toothed crown wheel 2 via a key 3.

On this toothed crown wheel 2 engage the teeth 4 of a barrel 5 in which bores 6 are provided for the pistons 7 of the hydraulic motor.

In known manner, the pistons 7 are hollow pistons with spherical head 8, each spherical head 8 lying against a swash-plate 9 via a shoe 10.

The barrel 5 is integral with a shaft 11, borne by two bearings 12 and 13, this shaft being parallel to the axis of shaft 1.

All these parts are positioned in a housing 14 inside which an inlet conduit 15 is provided for the hydraulic fluid under pressure and an outlet conduit 16 for said fluid.

Conduit 15 leads to a distributor 17 which is described in more detail below; this distributor 17 ensuring the sequential supply of pressurized fluid to bores 6.

The forces exerted one after the other by the pistons 7 (which total seven in the example shown) against the oblique surface of the swash-plate 9, which is fixed, cause the barrel 5 to rotate which drives shaft 1 in rotation.

With this arrangement, it is possible to avoid having to place end to end the hydraulic motor, consisting of pistons 7, swash-plate 9 and barrel 5, and the shaft 1, and it is therefore possible to achieve a very compact assembly which is most advantageous.

In addition, it can be seen that it is possible to arrange a plurality of barrel such as 5, hence of hydraulic motors, around the crown wheel 2; so that the extent of the drive torque applied to the shaft 1 can be determined at will.

FIG. 1 shows that the spherical heads 8 of the pistons 7 are held in position in their shoes 10 by a plate 18. For this purpose, the front face 19 of the barrel is conical, the conic angle of this cone being equal to the angle of the front face of the swash-plate so that as and when the barrel rotates a portion of said plate 18 is caught between the barrel 5 and one of the spherical heads 8 after the other.

As a result the plate 18 remains parallel at all times to the front face of the swash-plate.

This arrangement eliminates all the return springs of pistons 7 which are usually used.

This enables a hydraulic motor to be achieved which has no parasitic forces while remaining highly reliable in use since the shoes 10 housed between the swash-plate and the heads 8 of the pistons cannot escape.

Figure 4:
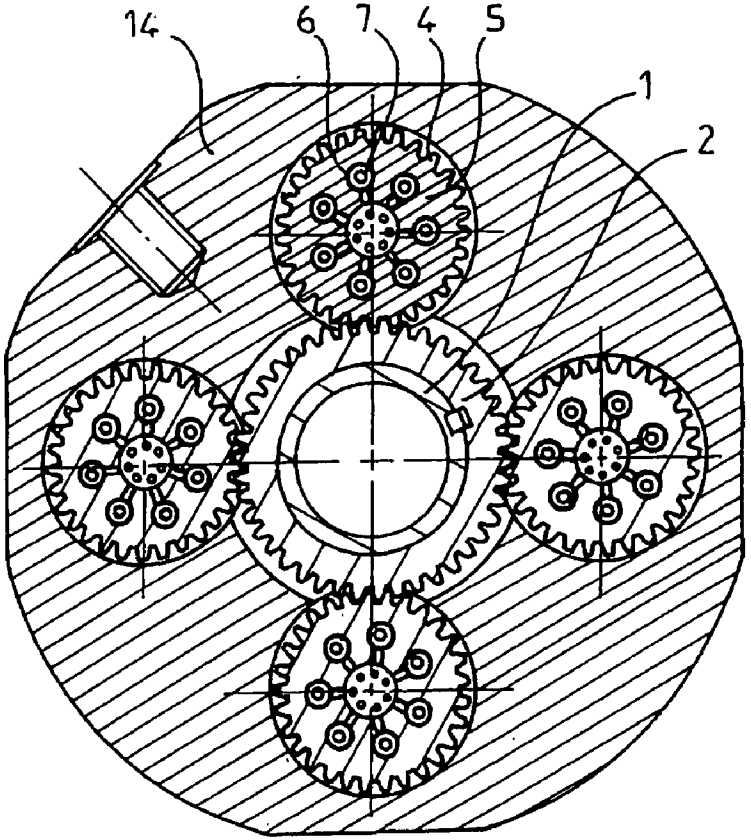
FIG. 4: a cross-sectional view along line CC in FIG. 3.
Figure 3:
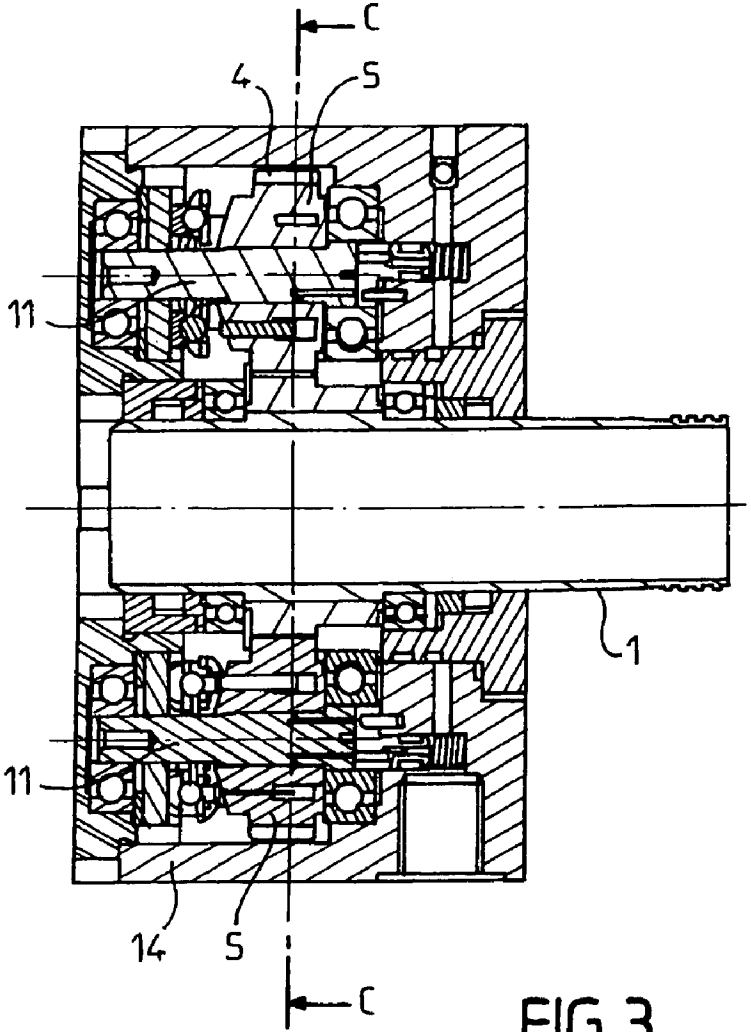
FIG. 3: a longitudinal section view illustrating a variant of embodiment of the device shown FIG. 1.
Figure 7:
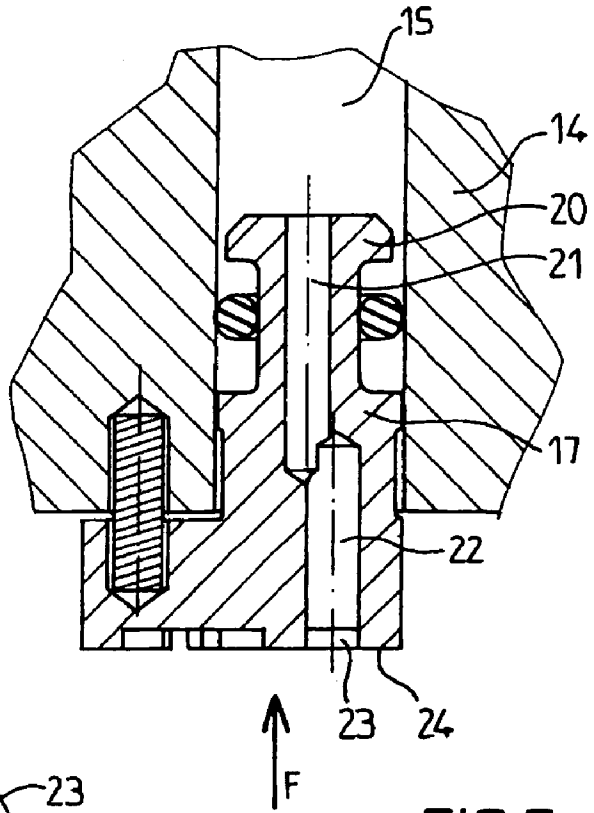
FIG. 7: an enlarged scale view of the distributor of the device according to the invention.
Figure 5:
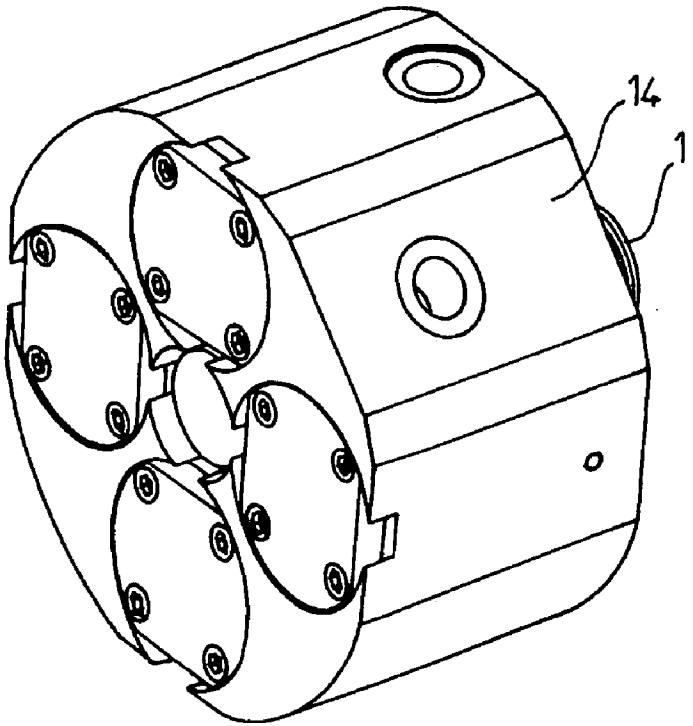
FIG. 5: a perspective view of the variant shown FIGS. 3 and 4.

FIGS. 3,4 and 5 show a variant of embodiment which gives a good illustration of the remarkable advantage of the present invention.

In this figures, the same parts carry the same references, but these references have not all been entered into FIG. 3 for reasons of clarity.

In these figures, it can be seen that the special design of the transmission between the hydraulic motor and the shaft 1 enables several hydraulic motors to be arranged around shaft 1, each barrel 5 of a hydraulic motor meshing directly with the crown wheel 2 of the shaft 1.

In FIGS. 3 and 4 four motors have been arranged, but evidently this is not restrictive; two, three and even more than four motors can be arranged in relation to the respective sizes of the barrel 5 and crown wheel 2.

This characteristic is of particular advantage since it is therefore possible to determine at will the torque that is transmitted to the shaft 1 while preserving an extremely compact device as illustrated FIG. 5.

Figure 6:
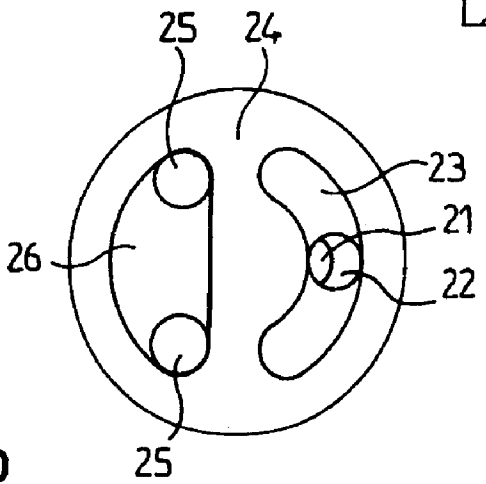
FIG. 6: a view along F in FIG. 7.

FIG. 6 shows a cross-section of the distributor 17 on an enlarged scale.

This distributor comprises a tail end 20 which is subjected to the high supply pressure arriving via conduit 15. Inside this tail end 20 a central conduit 21 is arranged which communicates with a conduit 22 leading into a groove 23 in the form of an arc of a circle centred on the axis of the rotating barrel 5 and is hollowed in the lower face 24 of the distributor 17.

Within the distributor 17 two reservoir return orifices 25 are also arranged communicating with conduit 6, these orifices 25 leading into a chamber 26 hollowed in the lower face 24 of the distributor 17.

The distributor 17 must be balanced hydrostatically and, since this gives rise to slight leakage flow from the groove (23) (at high pressure) and the chamber 26 (at low pressure), the shape and surface of the planar face 24 applied against the rear face of the barrel 5 and the shape and surface of the groove 23 and of chamber 26 must be determined by calculation to obtain both hydrostatic balancing of the distributor 17 and the absence of any parasitic torque. Since this calculation is purely mathematical it is not described herein.

The invention claimed is:

1. Hydraulic device driving a shaft (1) comprising at least one hydraulic motor having axial pistons (7) bearing against a fixed swash-plate (9) by means of shoes (10), said pistons (7) being arranged in a rotating barrel (5), characterized by the fact that said motor shaft (1) carries a toothed crown wheel (2) with which it is integral whose teeth are engaged by teeth (4) provided on the periphery of the rotating barrel (5) of one or more hydraulic motors (7) arranged around the shaft (1), the axis of axes of said barrel (5) being parallel to the axis of the shaft (1).

2. Hydraulic device as in claim 1 which comprises four hydraulic motors having a barrel (5) which are arranged around the shaft (1).

3. Hydraulic device as in claim 1 in which the pistons (7) each comprise a spherical head (8) bearing against the oblique face of the swash-plate (9), characterized in that the front face (19) of the barrel (5) is a conical surface having the same obliqueness as the face of swash-plate (9), a retainer plate (18) retaining the piston heads (8) lying against the front face (19) of the barrel (5); so that the shoes (10) via which the pistons (7) bear upon the swash-plate (9) are positioned between the swash-plate and the piston heads (8) and cannot escape, said spherical heads (8) being held permanently in place in their shoes (10) by said retainer plate (18).

4. Hydraulic device as in claim 1 in which each barrel (5) is supplied by a distributor (17) that is hydrostatically balanced and with no parasitic torque, which comprises a tail end (20) applied against the rear face of the barrel (5), said lower face comprising a groove in an arc of a circle (23) and a chamber (26) both hollowed in face (24), the groove (23) communicating with an inlet conduit (21) for pressurized fluid and the chamber (26) with one or more reservoir return orifices; the shape and surface of the face (24) applied against the rear face of the barrel (5) and the those of the groove (23) and chamber (26) being determined by calculation so that the distributor (17) is hydrostatically balanced and is not subject to any parasitic torque.

5. Hydraulic device as in claim 2 in which the pistons (7) each comprise a spherical head (8) bearing against the oblique face of the swash-plate (9), characterized in that the front face (19) of the barrel (5) is a conical surface having the same obliqueness as the face of swash-plate (9), a retainer plate (18) retaining the piston heads (8) lying against the front face (19) of the barrel (5); so that the shoes (10) via which the pistons (7) bear upon the swash-plate (9) are positioned between the swash-plate and the piston heads (8) and cannot escape, said spherical heads (8) being held permanently in place in their shoes (10) by said retainer plate (18).

* * * * *